US005558397A

United States Patent [19]

Chang

[11] Patent Number: 5,558,397

[45] Date of Patent: Sep. 24, 1996

[54] ROCKING CHAIR

[75] Inventor: Chih-Huang Chang, Taipei, Taiwan

[73] Assignee: Collins Co., Ltd., Taipei, Taiwan

[21] Appl. No.: 467,636

[22] Filed: Jun. 6, 1995

[51] Int. Cl.[6] ..... A47D 13/10

[52] U.S. Cl. ..... 297/281; 297/440.1; 297/258.1

[58] Field of Search ..... 297/281, 273, 297/282, 258.1, 440.1, 440.22, 440.24, 463.1, 452.18, 452.2, 272.1

[56] References Cited

U.S. PATENT DOCUMENTS

| | | | |
|---|---|---|---|
| 1,923,690 | 8/1933 | Rueter | 297/281 X |
| 3,982,785 | 9/1976 | Ambasz | 297/440.1 X |
| 4,108,415 | 8/1978 | Hauray et al. | 297/281 X |
| 5,026,121 | 6/1991 | Ratalahti | 297/440.1 X |
| 5,306,072 | 4/1994 | Caldwell | 297/440.1 X |
| 5,344,214 | 9/1994 | Trent | 297/273 X |

*Primary Examiner*—Milton Nelson, Jr.
*Attorney, Agent, or Firm*—Donald C. Casey

[57] ABSTRACT

A rocking chair including a chair body having two parallel stands supported on a base by a linking mechanism, the base including two upright frames and four stretchers connected between the upright frames, the linking mechanism including two symmetrical pairs of links and two stretchers connected between the links, each link having one end pivoted to one stand on the chair body and an opposite end pivoted to one upright-frame of the base, wherein the stretchers of the linking mechanism and base each has two metal female screws embedded at two opposite ends and fixed in place by a respective locating pin and connected to a respective through hole on the upright frames of the base or on the links by a respective screw bolt so that the base and the linking mechanism are detachable.

1 Claim, 4 Drawing Sheets

ROCKING CHAIR

BACKGROUND OF THE INVENTION

The present invention relates to rocking chairs, and relates more particularly to such a rocking chair which is detachable so that it needs less storage space when collapsed.

Regular rocking chairs are commonly comprised of a chair body, a base, and a linking mechanism connected between the chair body and the base for permitting the chair body to rock on the base. These rocking chairs are stable in use, however they need much storage space because they are not detachable. Furthermore, when one part or element of the rocking chair is damaged, the rocking chair becomes useless.

SUMMARY OF THE INVENTION

The present invention has been accomplished to provide a rocking chair which eliminates the aforesaid drawbacks. According to the preferred embodiment of the present invention, the rocking chair comprises a chair body having two parallel stands supported on a base by a linking mechanism, the base including two upright frames and four stretchers connected between the upright frames, the linking mechanism comprising two symmetrical pairs of links and two stretchers connected between the links, each link having one end pivoted to one stand on the chair body and an opposite end pivoted to one upright frame of the base, wherein the stretchers of the linking mechanism and base each has two metal female screws embedded at two opposite ends and fixed in place by a respective locating pin and connected to a respective through hole on the upright frames of the base or on the links by a respective screw bolt. Therefore, the base and the linking mechanism are detachable, and the connections between the stretchers and the links/upright frames are durable.

DETAILED DESCRIPTION OF THE PREFERRED EMBODIMENT

Figure 1:
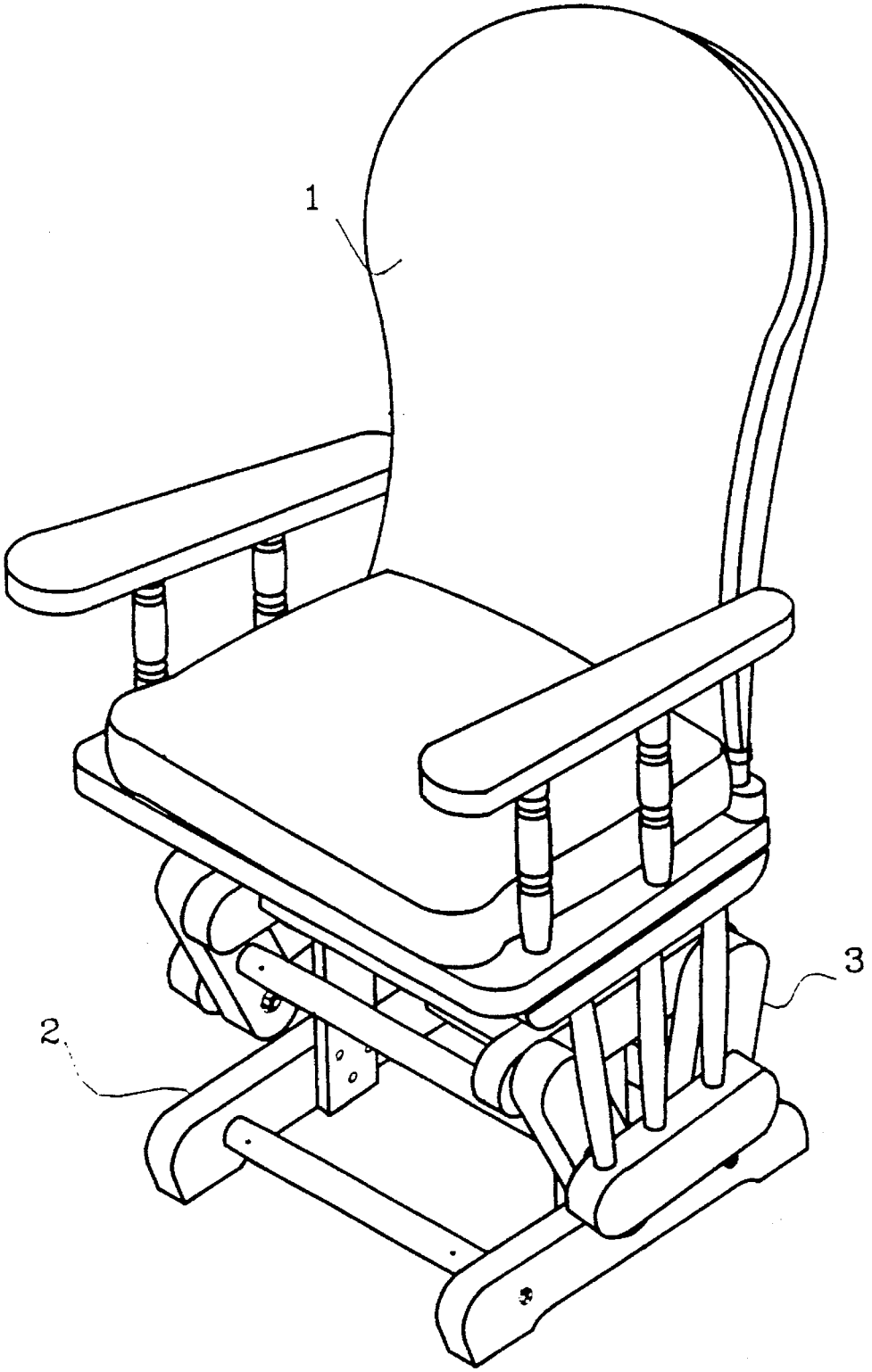
FIG. 1 is an elevational view of a rocking chair according to the present invention.
Figure 2:
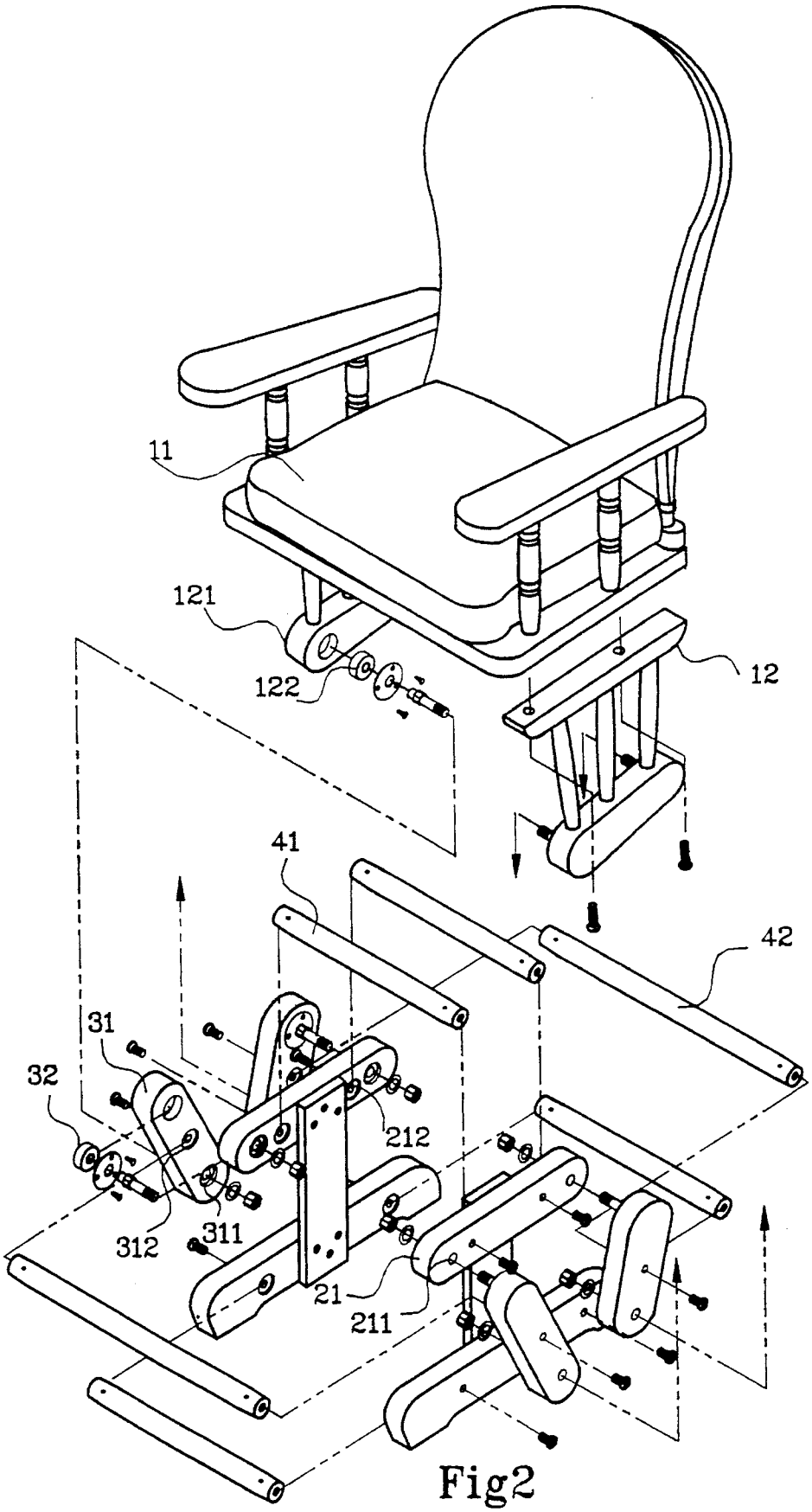
FIG. 2 is an exploded view of the rocking chair shown in FIG. 1.

Referring to FIGS. 1 and 2, the rocking chair in accordance with the present invention is generally comprised of a chair body 1, a base 2, and a linking mechanism 3 linked between the chair body 1 and the base 2 for permitting the chair body 1 to rock on the base 2.

The chair body 1 comprises a seat 11 and two stands 12 bilaterally disposed at the bottom of the seat 11. Each of the stands 12 has a horizontal bar 121 at the bottom and two bearings 122 at two opposite ends of the horizontal bar 121. The base 2 is comprised of two substantially I-shaped upright frames 21 joined by four stretchers 41, each upright frame 21 having two pivot holes 211 horizontally spaced at the top. The linking mechanism 3 comprises two symmetrical pairs of links 31 and two stretchers 42 respectively connected between the links 31. The links 31 have a respective pivot hole 311 at one end respectively and pivotably connected to the bearings 122 on the horizontal bars 121 of the stands 12 by respective screw bolts and nuts, and a respective bearing 32 at an opposite end respectively and pivotably connected to the pivot holes 22 on the upright frames 21 of the base 2 by respective screw bolts and nuts.

Figure 3:
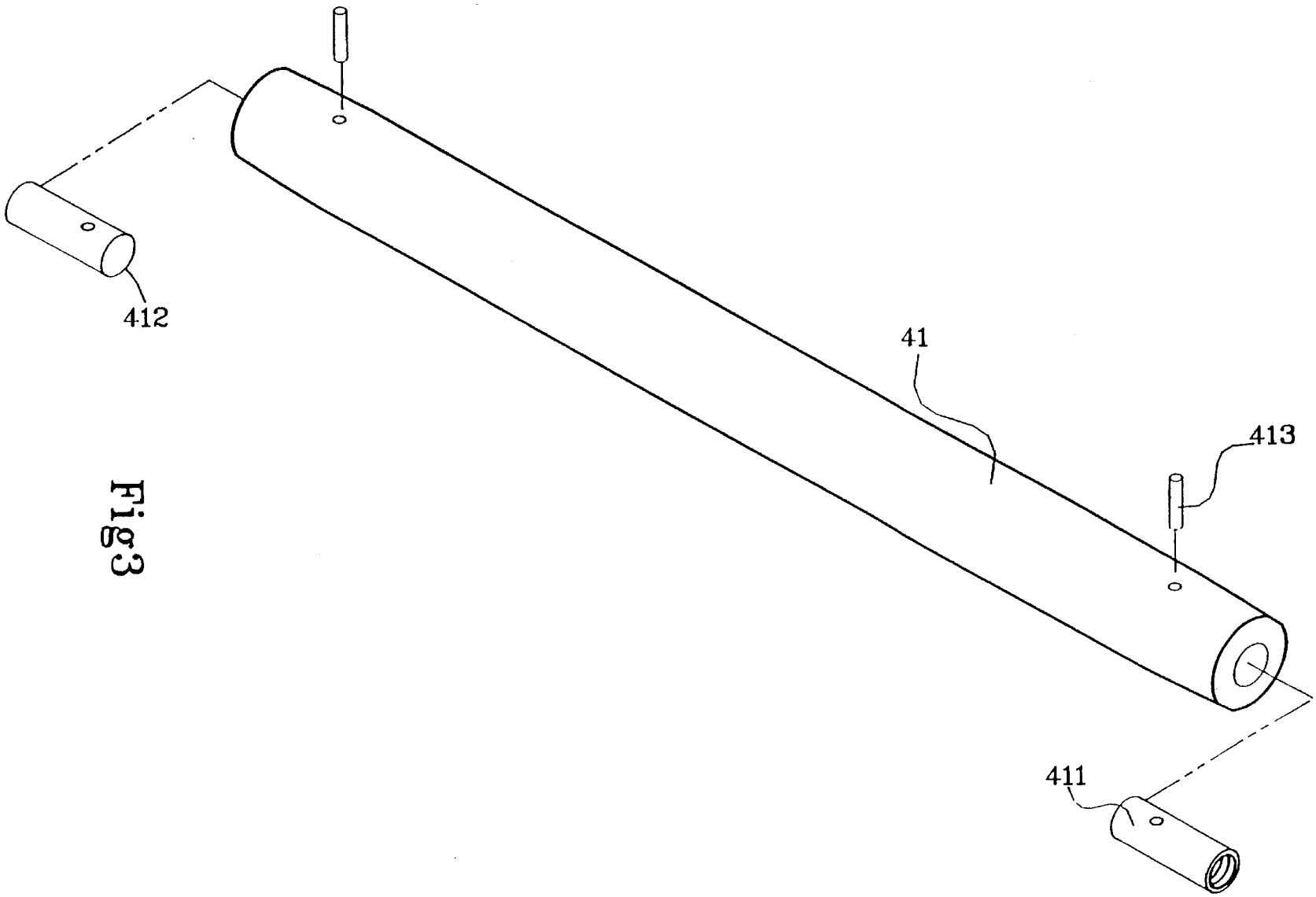
FIG. 3 is an exploded view of a stretcher according to the present invention.
Figure 4:
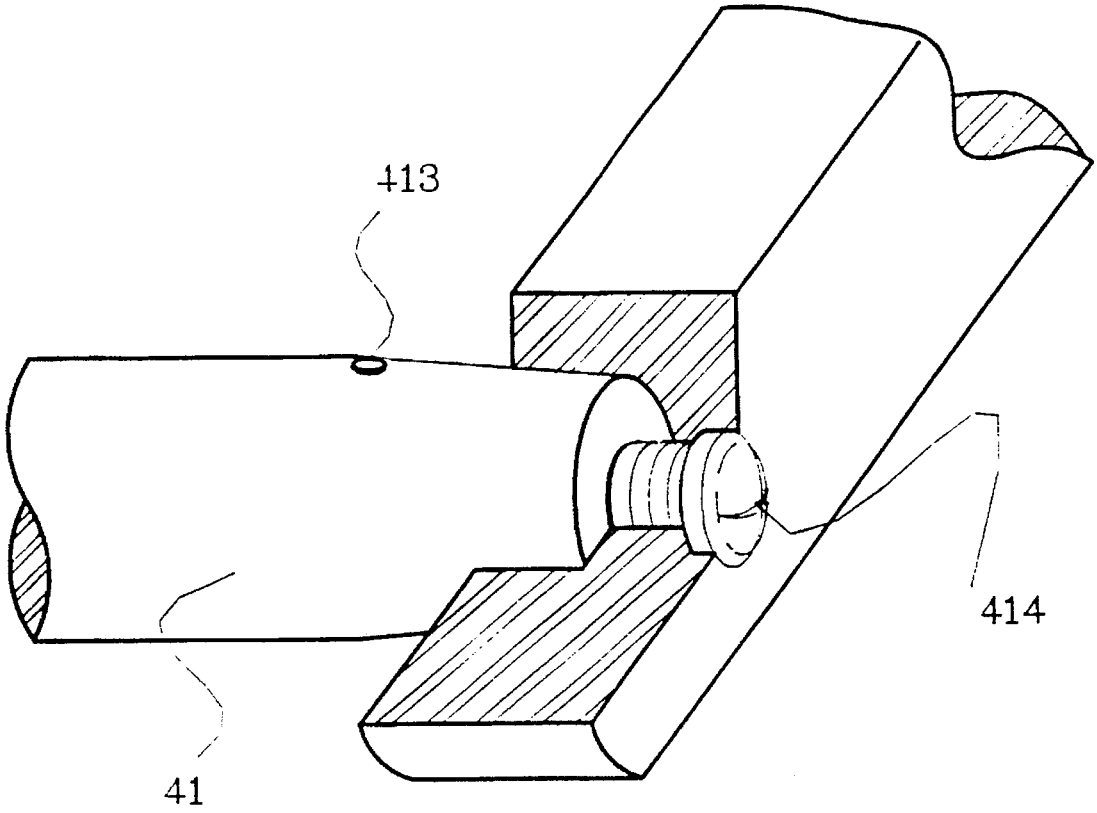
FIG. 4 is a cutaway showing the installation of a stretcher on one upright frame according to the present invention.

Referring to FIGS. 3 and 4, through holes 212 and 312 are respectively made on the upright frames 21 and the links 31 for mounting the stretchers 41 and the stretchers 42 by screw bolts. The stretchers 41 as well as the stretchers 42 each having two metal female screws 411 and 412 embedded at two opposite ends and fixed in place by a respective locating pin 413. By inserting screw bolts 414 into the through holes 212 and 312 and then threading them into the female screws 411 and 412 respectively, the stretchers 41 and the stretchers 42 are respectively fastened to the upright frames 21 and the links 31. Because of the aforesaid arrangement, the base 2 and the linking mechanism 3 are detachable. Therefore, the rocking chair needs less storage space when it is collapsed.

It is to be understood that the drawings are designed for purposes of illustration only, and are not intended as a definition of the limits and scope of the invention disclosed.

I claim:

1. A rocking chair comprising:

a chair body having two parallel stands and a seat supported on said stands, each stand having a horizontal bar and two bearings at two opposite ends of said horizontal bar;

a base, said base comprising two substantially I-shaped upright frames, and four stretchers connected between said upright frames, each upright frame having two pivot holes horizontally spaced at a top side thereof; and a linking mechanism connected between said stands of said chair body and said base for permitting said chair body to rock on said base, said linking mechanism comprising two symmetrical pairs of links and two stretchers respectively connected between said links, each link having a pivot hole at one end pivotably connected to one bearing on the horizontal bar of one stand by a respective pivot means, a bearing at an opposite end pivotably connected to one pivot hole on one upright frame of said base by a pivot means;

wherein each of the stretchers of said linking mechanism and said base each comprises two metal female screws embedded at two opposite ends and fixed in place by a respective locating pin and connected to a respective through hole on said upright frames of said base or on said links by a respective screw bolt so that said base and said linking mechanism are detachable.

* * * * *